US006042441A

United States Patent [19]

Konuma

[11] Patent Number: 6,042,441

[45] Date of Patent: Mar. 28, 2000

[54] METHOD OF CLEANING THE CATHODE OF A CATHODE RAY TUBE AND A METHOD FOR PRODUCING A VACUUM IN A CATHODE RAY TUBE

[75] Inventor: Kazuo Konuma, Tokyo, Japan

[73] Assignee: NEC Corporation, Tokyo, Japan

[21] Appl. No.: 09/053,768

[22] Filed: Apr. 2, 1998

[30] Foreign Application Priority Data

Apr. 3, 1997 [JP] Japan ..... 9-085086

[51] Int. Cl.[7] ..... H01J 9/44

[52] U.S. Cl. ..... 445/6

[58] Field of Search ..... 445/6

[56] References Cited

U.S. PATENT DOCUMENTS

| | | | |
|---|---|---|---|
| 4,457,731 | 7/1984 | Patrickson et al. | 445/6 |
| 4,668,203 | 5/1987 | Giudici | 445/6 |
| 5,658,180 | 8/1997 | Takagi | 445/6 |

FOREIGN PATENT DOCUMENTS

| | | |
|---|---|---|
| 4032130 | 2/1992 | Japan . |
| 432131 | 2/1992 | Japan . |
| 7085793 | 3/1995 | Japan . |
| 8077929 | 3/1996 | Japan . |
| 8124502 | 5/1996 | Japan . |

*Primary Examiner*—Kenneth J. Ramsey
*Attorney, Agent, or Firm*—Sughrue, Mion, Zinn, Macpeak & Seas, PLLC

[57] ABSTRACT

A getter in a tube body is heated in an exhaust process of a cathode ray tube, and during the time gas is emitted due to the heating of the getter, electrons are emitted from the cathode. Then the exhaust tube of the tube body is sealed to maintain a high vacuum by utilizing the absorbing function of the getter.

9 Claims, 8 Drawing Sheets

METHOD OF CLEANING THE CATHODE OF A CATHODE RAY TUBE AND A METHOD FOR PRODUCING A VACUUM IN A CATHODE RAY TUBE

BACKGROUND OF THE INVENTION

1. Field of the Invention

The present invention relates to a cathode ray tube having a getter for obtaining a high vacuum.

2. Description of the Related Art

A conventional cathode ray tube is processed to further increase the level of its vacuum by first exhausting a cathode ray tube having a getter, then sealing the exhaust tube, heating the getter with a high frequency induction heater to evaporate and scatter it for thereby absorbing the residual gas in the cathode ray tube.

As examples of the cathode ray tube (CRT), there are a Braun tube or a flat display panel (FDP) to be used in a television receiver or a monitor screen of a computer, or further a traveling-wave tube (TWT) to be used in a high frequency amplifier or a high frequency oscillator.

A structure of the conventional cathode ray tube will be described with reference to FIG. 1.

As shown in FIG. 1, a CRT comprises tube body 1 which serves as a vacuum vessel, cathode 2 which serves as an electron emission source, and getter 3 for augmenting the degree of vacuum.

Further, tube body 1 comprises tip tube 4 to be used as an exhaust port. Tip tube 4 is made of glass and heated by a heater, and accordingly softened and sealed, when an exhausting operation is completed. In the neighborhood of cathode 2 in the direction of electron emission from cathode 2, electron lens 6 is provided for controlling an orbit of the electron. Hermetic pin 5 is provided for impressing voltage on electron lens 6 and cathode 2.

As an electron emission source, there are used a hot cathode for emitting electrons by heating its target made of a substance which can easily emit electrons, or a field-emission type cold cathode called as a microfield emitter. The field-emission type cold cathode is manufactured by preparing a cathode cone on a conductive substrate as a sharp electron emitter of a cone shape, providing an insulation layer on the conductive substrate in such a manner to enclose the cathode cone, and providing on the insulation layer a gate layer having a hole of a submicron level which exposes the cathode cone. By providing voltage of a positive electrode to the cathode cone for the gate layer, electrons are emitted from the tip of the cathode cone. This technique is described in, for example, Japanese laid-open patent publication No.147129/1995. A device housing a getter is described in Japanese laid-open patent publication No.124502/1996. Barium is generally used as a getter and such getter is called a barium getter. This barium getter is generally composed of barium-nickel alloy so that the alloy can be stable in the tube body which has not yet become a vacuum.

Next, a vacuum device of the above CRT is described with reference to FIG. 2.

Tip tube 4 of CRT tube body 1 is connected to exhaust manifold 7 having an O ring made of rubber. For hermetically sealing the connection part of tip tube 4 and exhaust manifold 7, exhaust manifold 7 tightly holds the outside wall of tip tube 4 through the rubber O ring. Vacuum pump 9 is connected to exhaust manifold 7 through valve 8.

Since the desirable vacuum of the cathode ray tube is in a range of $1\times10^{-5}$ Torr to $1\times10^{-9}$ Torr, a combination of an oil diffusion pump and an oil rotary pump or a combination of a turbo molecular pump and the oil rotary pump is used as vacuum pump 9. However, since the above vacuum is hard to achive only by exhaustion through a small tip tube, it is generally known to jointly employ an absorbing function to be provided by a getter, and hence getter 3 is provided in tube body 1 and induction heating coil 11 is provided on the outside of tube body 1 as a means for heating getter 3.

High frequency induction heating coil 11 is set up to generate energy enough for evaporating and scattering getter 3. Descriptions are made with reference to heating of the getter in Japanese laid-open patent publication No.85793/1995 or No.124502/1996. Further, in some cases, an optical sensor which is used for monitoring the heating state of the getter by color is disposed in the CRT for monitoring the temperature of the getter through a transparent portion of the CRT.

For the purpose of augmenting the degree of vacuum in the tube body and reducing the exhaust time, tube body 1 is housed in heating furnace 10. Since the softening point of glass constituting tube body 1 is about 400° C., heating furnace 10 is prepared so that it heats the tube body 1 at a temperature of below 400° C. When tube body 1 is heated, the temperature of tip tube 4 and exhaust manifold 7 are also raised, although exhaust manifold 7 is partially held cold. If there is an extreme temperature difference in glass tip tube 4 between the exhaust manifold 7 end and tube body 1, end a crack is produced in tip tube 4. Therefore, exhaust manifold 7 is controlled so that it may not be excessively cooled.

High frequency induction coil 13 for baking(specifically heating) an electrode of electron lens 6 and electric heater 12 for sealing tip tube 4 are provided on the outside of tube body 1.

Next, the epitome for a vacuum producing method of CRT to be implemented by using the above device is described with reference to FIG. 3.

First, tip tube 4 of tube body 1 is attached to exhaust manifold 7. Then, the exhaustion of tube body 1 is started. Thereafter, tube body 1 is heated and cooled by heating furnace 10 according to a fixed temperature profile of the first half heating and the latter half cooling. In the cooling process, tip tube 4 of tube body 1 is sealed. The exhaustion of tube body 1 is continued until tip tube 4 is sealed.

The method of heating and cooling tube body 1 by heating furnace 10 according to the fixed temperature profile is described, for example, in Japanese laid-open patent publication No.32130/1992. Further, a process called "electrode baking" is often performed in the period of the above tube heating process. The "electrode baking" is a process for applying high frequency induction heating to electron lens 6 in tube body 1 to make lens 6 emit gas from the electrode thereof. The gas emitted by the "electrode baking" is generally exhausted in the above cooling process of tube body 1.

Further in the exhausting process of tube body 1, a process for evaporating and scattering getter 3 is performed immediately before sealing tip tube 4. Or, in some case, getter 3 is evaporated and scattered after tip tube 4 is sealed. Although the getter has an absorbing function for the gas other than inert gas, no absorbing function is expected for inert gas such as argon or helium.

The method of evaporating and scattering getter 3 before sealing tip tube 4 has an advantage that a part of the inert gas emitted from getter 3 can be removed by vacuum pump 9. On the contrary, when getter 3 is evaporated and scattered after tip tube 4 is sealed, disadvantageously the emitted inert gas remains as it is. In the latter case, it is known that in particular a large quantity of argon gas remains.

In the former case, evaporated and scattered getter 3 shows, immediately after being scattered, a comparatively quick absorbing function for gas other than inert gas.

Therefore, if the exhausting operation is performed for a long time without sealing tip tube 4 after getter 3 is evaporated and scattered, getter 3 comes to attract and absorb the gas other than the inert gas in vacuum pump 9, thereby causing an inverse pressure phenomenon. If the inverse pressure phenomenon takes place, the stain such as the oil of the vacuum pump transfers into tube body 1 thereby severely degrading the vacuum in tube body 1. Therefore, the sealing operation of tip tube 4 must be performed before the inverse pressure phenomenon as above takes place.

Further, in the former case, a microfield emitter is driven after tip tube 4 is sealed to test the driving condition. Particularly, the time when cathode 2 emits electrons is the period of a high vacuum of $1\times10^{-9}$ Torr or less (hereinafter called a "high vacuum mode") produced by the absorbing function of getter 3 after tip tube 4 is sealed. In other words, as shown in FIG. 4, the microfield emitter is not driven in the period when the vacuum level is degraded by gas emitted from getter 3 (hereinafter called a "gas emission mode") after the getter is heated, and is first driven for emitting electrons after the tube has entered the "high vacuum mode".

Here, it is to be noted that with reference to the CRT which uses a cathode called an oxide cathode, a process called cathode decomposition is generally implemented such that the cathode is electrically heated in the period of relatively high oxygen density just after commencement of the exhausting operation, but this process is intended to oxidize the cathode and is not intended to cause electron emission.

As described above, since the conventional vacuum producing method of the cathode ray tube has had a problem that the inert gas remains in tube body 1, can not be removed after tip tube 4 is sealed, sealing of tip tube 4 is performed after the getter evaporation and scattering process which emits a large quantity of inert gas. However, in this case, as previously described, tip tube 4 must be sealed before the inverse pressure phenomenon appears.

On the one hand, cathode 2 of the cathode ray tube requires the advance processing for improving the electron emission characteristic thereof. The reason is that, for example, the electron emission efficiency of the cold cathode using a microfield emitter is lowered if the tip of the emitter cone made of molybdenum metal is spoiled or oxidized. As an advance processing method, there are various methods such as a method of cleaning the cathode surface by applying a heating process to the cathode in vacuum, a method of causing the self augmentation of electron emission (this process is usually called aging) by making the cathode continuously emit electrons, or a method of removing the pollution or oxide layers on the surface of the cathode through ion sputtering. If the pollution of the cathode is heavy or the cathode surface has thick oxide, ion sputtering is the most effective advance processing technique.

Further, in order to keep the cathode surface free from the compounds after removal of the pollution, inert gas is preferably used as the sputtering gas.

However, according to the conventional technique, the advance processing of the cathode is not executed during the exhausting process of the cathode ray tube, by introducing a necessary amount of the sputtering gas into the tube.

SUMMARY OF THE INVENTION

An object of the present invention is to provide a cleaning method for cleaning a cathode of a cathode ray tube and a method of producing a vacuum in the cathode ray tube which allow improvement of the electron emission characteristic through cleaning of the cathode, while exhausting the tube of the cathode ray tube to obtain a required vacuum.

In order to achieve the above object, according to the present invention, when the tube of the cathode ray tube is exhausted, the cathode emits electrons during a period in which the gas is emitted through heating of a getter provided in the cathode ray tube for maintaining the vacuum of the tube. Consequently, the gas emitted from the getter is ionized and the ions collide with the cathode to produce the sputtering effect, thereby cleaning the cathode and improving the electron emission characteristic of the cathode.

Particularly, electrons are emitted when the sum of the partial pressure of the gas of (the mass number four or less) contained in the component of the gas emitted from the getter, is 50% or more of the full pressure of the emitted gas. Accordingly, sputtering effect is mainly produced by ions of the low mass gas, and hence damage of the cathode can be reduced. At the same time, the gas or a secondary electron emitted from the cathode due to sputtering effect is reduced to small quantity, and consequently, a discharge breakage be induced by the sputtering effect may be suppressed.

Further, in the electron emission period, the potential difference between the electric potential of an electron emission part (for example, a cathode cone of the microfield emitter) of the cathode and the electric potential of any part in the tube body is controlled to 100 V or less. By controlling in this way, the discharge breakdown to be induced by the ion impact is suppressed.

The above and other objects, features and advantages of the present invention will become apparent from the following description with reference to the accompanying drawings which illustrate examples of the present invention.

DESCRIPTION OF THE PREFERRED EMBODIMENTS

A cathode cleaning method to be executed in an exhausting process of a CRT which uses a microfield emitter as a cathode is described with reference to FIG. 5.

Figure 3:
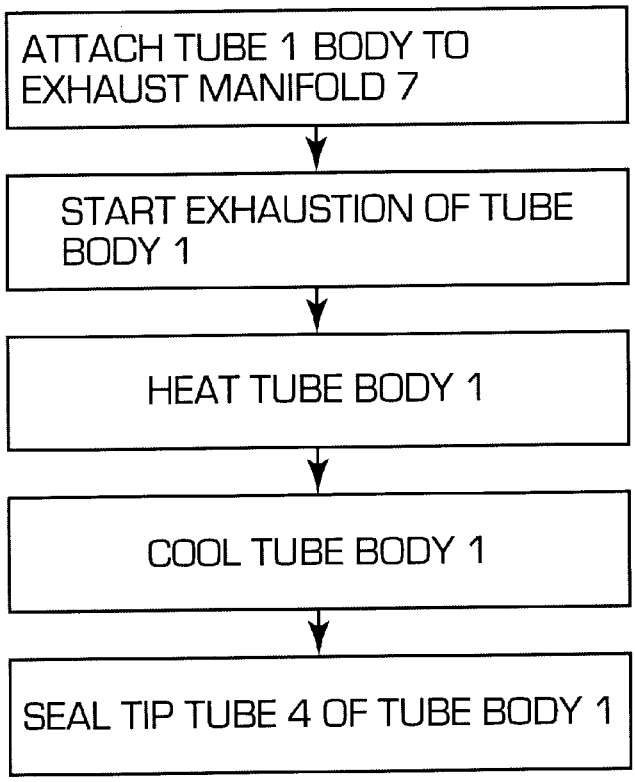
FIG. 3 PRIOR ART
FIG. 3 is a flow chart illustrating an exhausting process of the conventional cathode ray tube.
Figure 4:
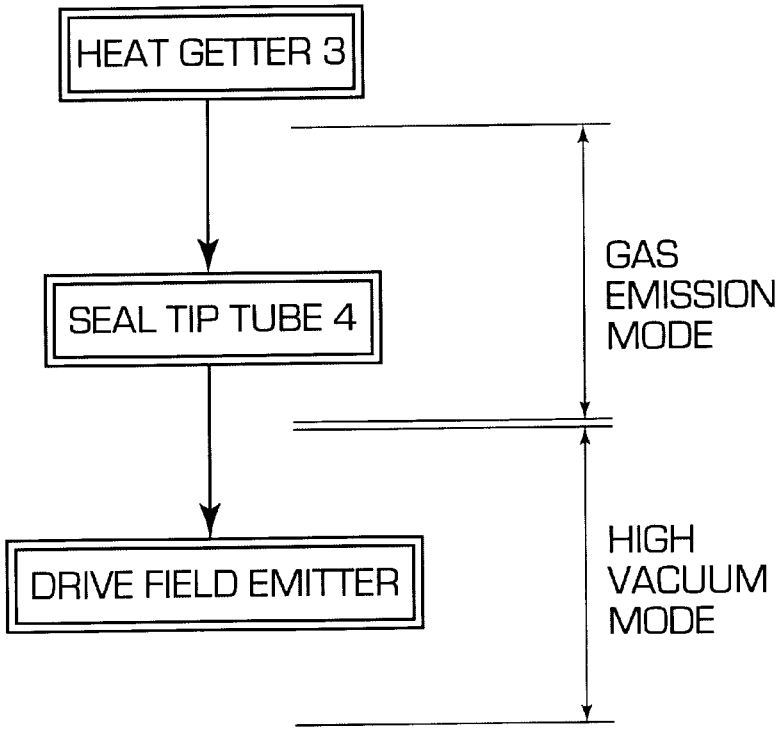
FIG. 4 PRIOR ART
FIG. 4 is a flow chart illustrating a getter heating process and the following process which belong to the exhausting process of the conventional cathode ray tube.

The epitome of the exhausting process of this CRT is as described before based on FIG. 3 and FIG. 4. The process of heating, evaporating and scattering a getter is performed just before sealing an exhaust tube of the CRT. The vacuum of a tube body in which the getter is heated is to be maintained at $1\times10^{-6}$ Torr or less.

Figure 5:
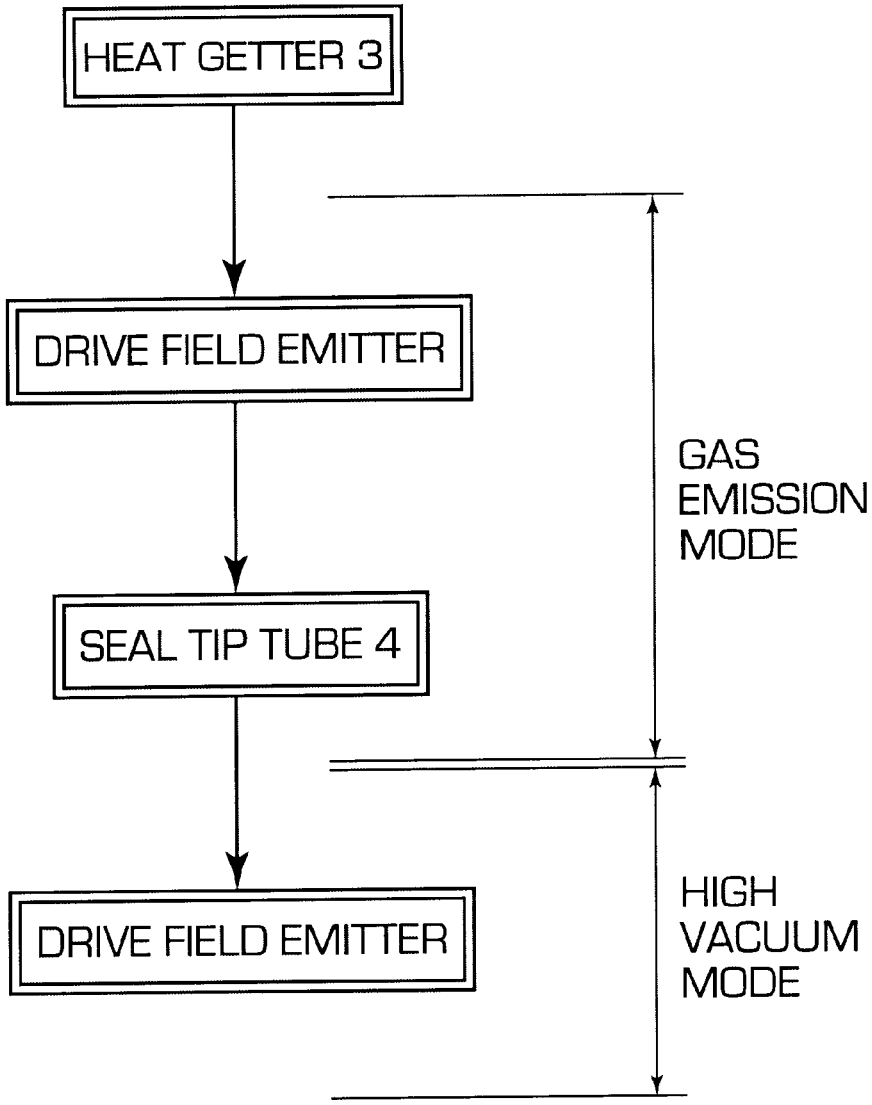
FIG. 5 is a flow chart illustrating a characteristic part of the exhausting method in the best mode with reference to a CRT which serves as the cathode ray tube according to the present invention.

As shown in FIG. 5, when the getter is heated, the substance contained in the getter and its receptacle are emitted as gas. In the first half of the "gas emission mode" just after the getter heating process, various kinds of gas exist in the tube body of the CRT. The greater part of which is the atmosphere gas which was present in the getter manufacturing process, being similar to the atmosphere component, including nitrogen, oxygen, hydrogen and in addition, inert gas such as argon or helium.

In the latter half of the "gas emission mode", according to the absorbing function of the getter, active gases such as nitrogen, oxygen and hydrogen are reduced and the primary component of the residual gas becomes two kinds of inert gas, argon and helium. The gas condition of this time is such that the partial pressure of the gas components other than argon and helium is $1\times10^{-8}$ torr or less and the sum of partial pressures including argon and helium is between $1\times10^{-8}$ Torr and $1\times10^{-6}$ Torr.

In the latter half of the "gas emission mode", for the purpose of cleaning the cathode, voltage is impressed between the gate of the microfield emitter; which is the cathode of the CRT) and the cathode cone to emit electrons from the cathode cone. Then, electric potential of 500 V is commonly impressed on the electron lens disposed near the cathode. The electric potential of an aperture grill for passing the electron is also 500 V. The electric potential of said gate is made 0 V and the initial potential of the cathode cone is set to −80 V, where the initial potential is an electric potential which is initially given to the cathode. Here, while monitoring a cathode current at a time period of 1 second, the electric potential of the cathode cone is increased so that the cathode current may not exceed 10 microampere (bring close to 0 V). Even if the cathode current has not yet reached 10 microampere, the potential of the cathode is not reduced (does not deviate from 0 V). Here, a microfield emitter composed of 1000 cathode cones arranged in an area 50 micron in diameter, is used.

Electron emission generated by driving the microfield emitter is finished in 1 or 2 minutes, and after the partial pressure of argon has become $1\times10^{-8}$ Torr or less, the tip tube is sealed. However, the exhausting operation is continued until sealing is completed.

After sealing the tip tube, the partial pressure of the residual gas, particularly of the active gas is reduced due to the absorbing function of the getter. In the state in which the partial pressure of the residual gas other than argon and helium is $5\times10^{-9}$ Torr or less, the microfield emitter is driven for confirming whether the CRT operates normally. A drive test of the microfield emitter is commonly executed by using a method usually called raster scanning.

Further, cleaning of the cathode in the above CRT will be concretely described with reference to FIG. 6 and FIG. 7.

Figure 6:
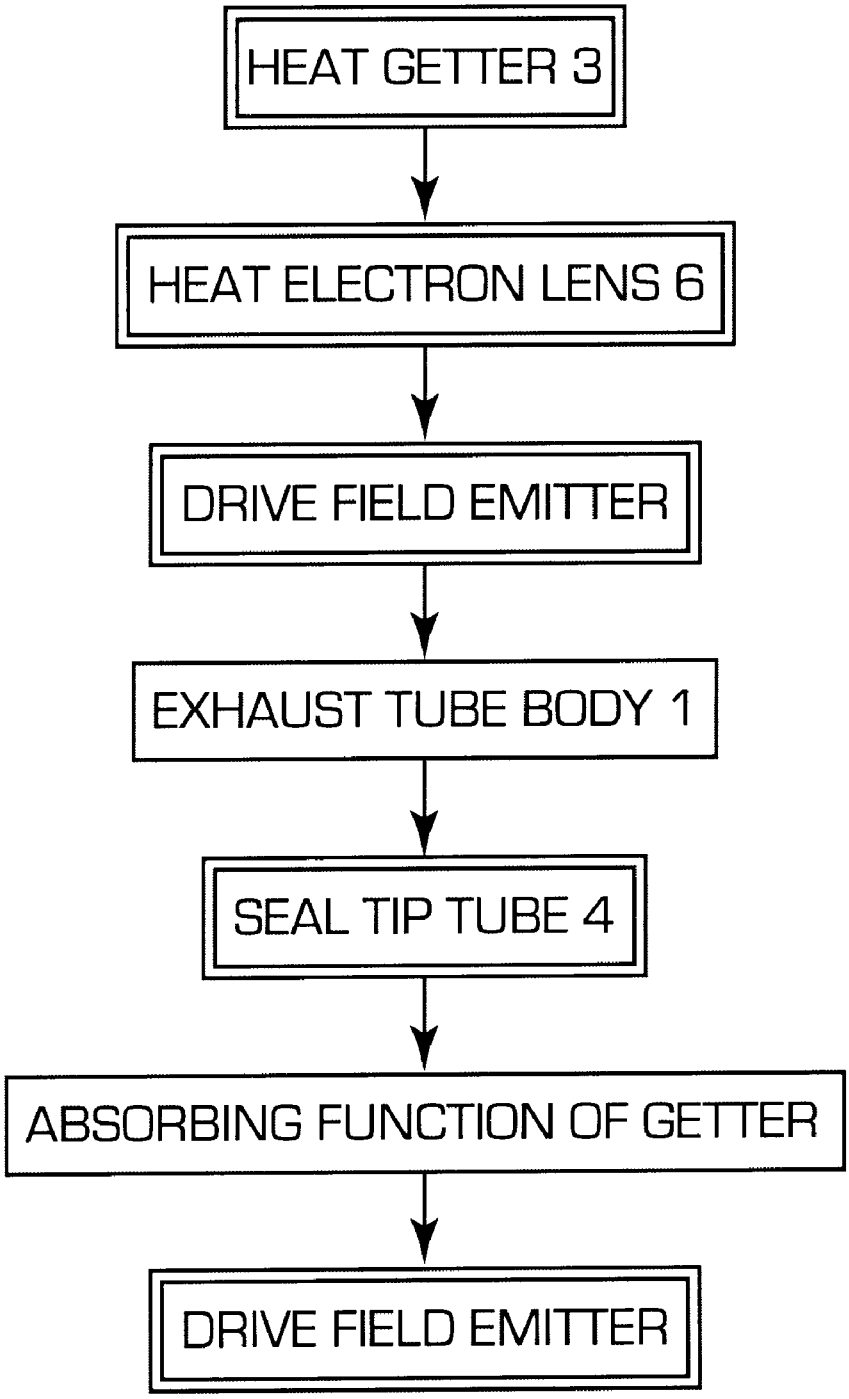
FIG. 6 is a flow chart for explaining in detail the exhausting method of the CRT which serves as the cathode ray tube according to the present invention.

As shown in FIG. 6, following the heating of the getter, the electron lens in the CRT is heated. Then, the microfield emitter, which is the cathode, is driven to emit electrons. During this period of electron emission, the cathode cone surface of the emitter is cleaned due to the sputtering function caused by a collision of the residual gas ions in the tube body. After driving the emitter, the tip tube of the CRT is sealed. Then, leaving the tube body as it is for more than 30 minutes after sealing, the vacuum level inside the tube body is further increased by the absorbing function of the getter. Thereafter, the emitter is again driven for confirming the driving condition. This driving test is performed according to the raster scanning method.

It is to be noted that a process shown by a double line frame in FIG. 6, for example, a "HEAT GETTER 3" process represents a process which practically starts and finishes at that point. On the one hand, a process shown by a single line frame, for example, an "EXHAUST TUBE BODY 1" process represents a process which is operated continuously from before the "HEAT GETTER 3" process up to the instance of completion of "SEAL TIP TUBE 4" process, for example, by the exhaust type vacuum pump such as a turbo molecular pump or an oil diffusion pump. Also, an "ABSORBING FUNCTION OF GETTER" process shows a process which starts from the instance of getter heating and further continues after the process shown in FIG. 6 is completed.

Successively, the vacuum level in the tube body which corresponds to each process shown in FIG. 6 will be described with reference to FIG. 7.

Figure 7:
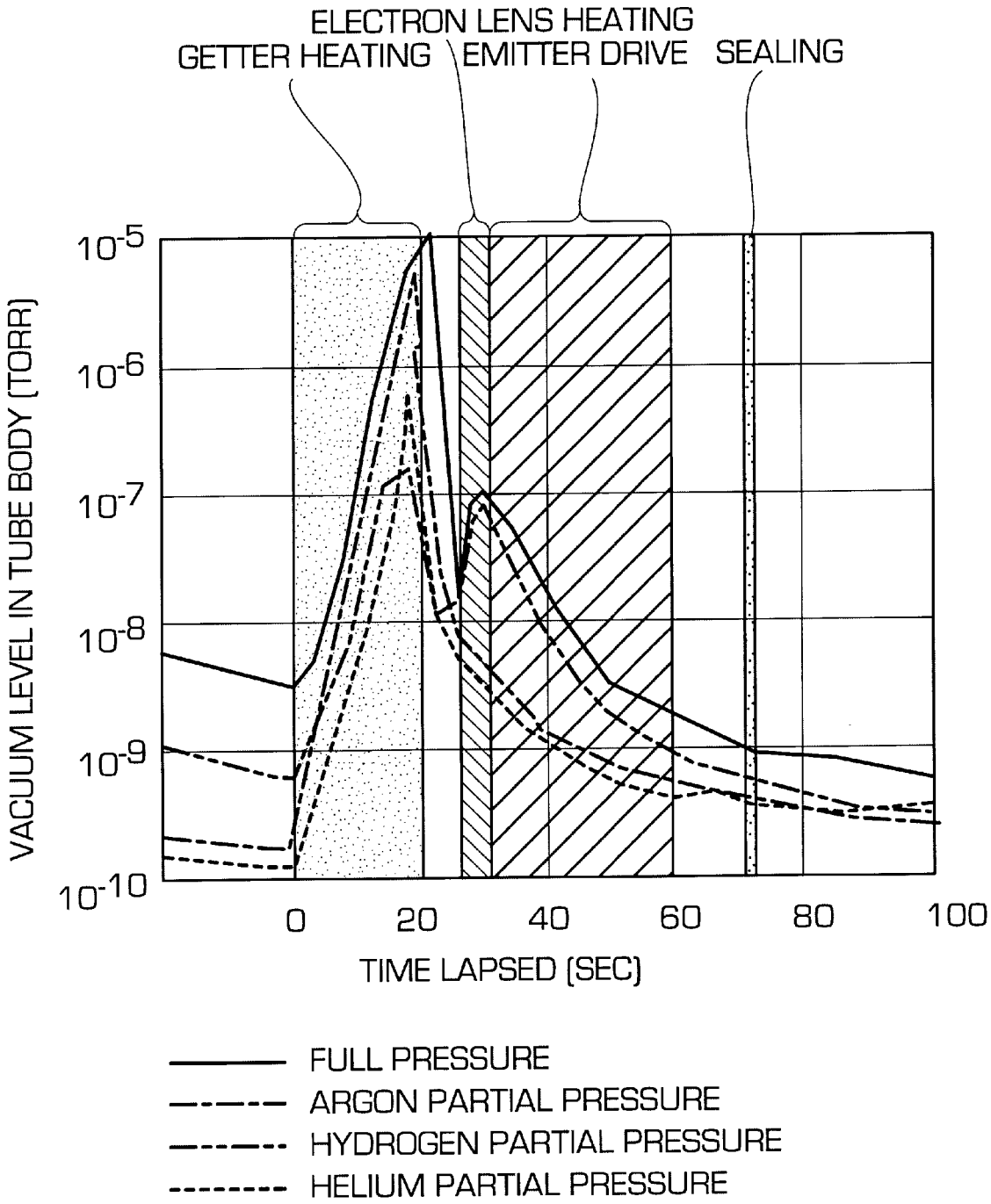
FIG. 7 is a graph showing the pressure condition in the tube body according to each process illustrated in FIG. 6.

As shown in FIG. 7, the getter heating operation is started under the condition that the full pressure in the tube body is $1\times10^{-8}$ Torr or less. When the temperature of the getter and its receptacle are raised by heating of the getter, the full pressure and the argon partial pressure in the tube body are increased. As a result of heating the getter for 20 seconds, the full pressure reaches $1\times10^{-5}$ Torr. By stopping the heating of the getter, the getter temperature is lowered to decrease the speed of the gas to be emitted from the getter. As a result, the vacuum in the tube body is increased through the exhaustion by the vacuum pump. After getter heating is terminated, the getter absorbing function is additionally effected and hence the increasing speed of the vacuum becomes larger than that obtained before the getter heating operation is performed.

5 seconds after stopping getter heating (25 seconds, measured from the getter heating start), electron lens heating is started. The electron lens has been processed through high temperature heating of 800° C. or more in the vacuum condition in the tube body since before the process shown in FIG. 6. As shown in FIG. 7, the full pressure in the tube body is increased by starting the heating of the electron lens. The heating temperature of the electron lens is regulated to prevent the drop of the full pressure so that the full pressure in the tube body may not become the state of the inverse pressure against the exhausting capacity of the vacuum pump. For example, the heating temperature of the electron lens is maintained at 300° C. The electron lens is processed by heating in advance in an hydrogen atmosphere before it is attached to the tube body. Therefore, at the above temperature (300° C.), the main component of the gas emitted from the electrode of the electron lens is hydrogen. Consequently, the pressure in the heating period of the electron lens is, as shown in FIG. 7, mainly composed of the pressure of hydrogen. The full pressure in the heating period of the electron lens is maintained within the inverse pressure limit of $1\times10^{-9}$ Torr or more and $1\times10^{-7}$ Torr or less.

After executing "electrode baking" as above for 5 seconds, a first emitter drive is immediately performed. The emitter drive means the operation which impresses voltage between a gate of the microfield emitter which constitutes a cathode and a cathode cone to emit electrons from the cathode cone. The time period of the emitter drive process is 30 seconds. During this period of time, the full pressure is in the range of $1\times10^{-9}$ Torr or more and $1\times10^{-7}$ Torr or less, where the sum of the partial pressure of helium and hydrogen holds 50% or more of the full pressure. By regulating the exhausting conductance of the vacuum pump and the quantity as well as the quality of the getter, the sum of the partial pressure of helium and hydrogen is maintained so as to keep a ratio of 50% or more of the full pressure. Since the vacuum pump has the high exhausting capacity for the gas of a large mass number such as argon, the partial pressure of argon can be reduced by increasing the exhausting conductance. Further, the partial pressure of the active gas such as oxygen, nitrogen and hydrogen can rapidly be reduced by utilizing the absorbing function of the getter. Since an oxygen molecule or a nitrogen molecule has a relatively large mass number, the vacuum pump can exhaust each effectively. By regulating these conditions, the sum of the partial pressure of helium and hydrogen is maintained at the ratio of 50% or more of the full pressure. During the period of the emitter drive, ions of the residual gas of the low mass value (mass number 4 or less) such as helium or hydrogen ionized by electrons mainly collide with the surface of the cathode cone mildly, thereby cleaning the surface of the cathode cone. Since the sputtering function is caused by ions of low mass gas, a number of cascades produced within molybdenum which is the material of the cathode cone becomes reduced. Consequently, the damage of the cathode cone decreases. At the same time, the quantity of the gas or secondary electrons to be emitted from the cathode cone due to the sputtering function is reduced, and resultantly the discharge breakage to be induced by the sputtering function is suppressed.

After driving the emitter in this way, sealing of the tip tube is performed after the vacuum level is increased according to two effects produced by the exhaustion by the vacuum pump and the absorbing function of the getter. In this case, the full pressure is $1\times10^{-9}$ Torr which is close to the inverse pressure limit. In other words, sealing of the tip tube is performed in the period of time when the full pressure does not become equal to or below the inverse pressure limit. Then wait for 30 minutes until the vacuum level is further increased due to the absorbing function of the getter produced after the tip tube is sealed, and then the second emitter drive is performed by the raster scanning method.

Figure 1:
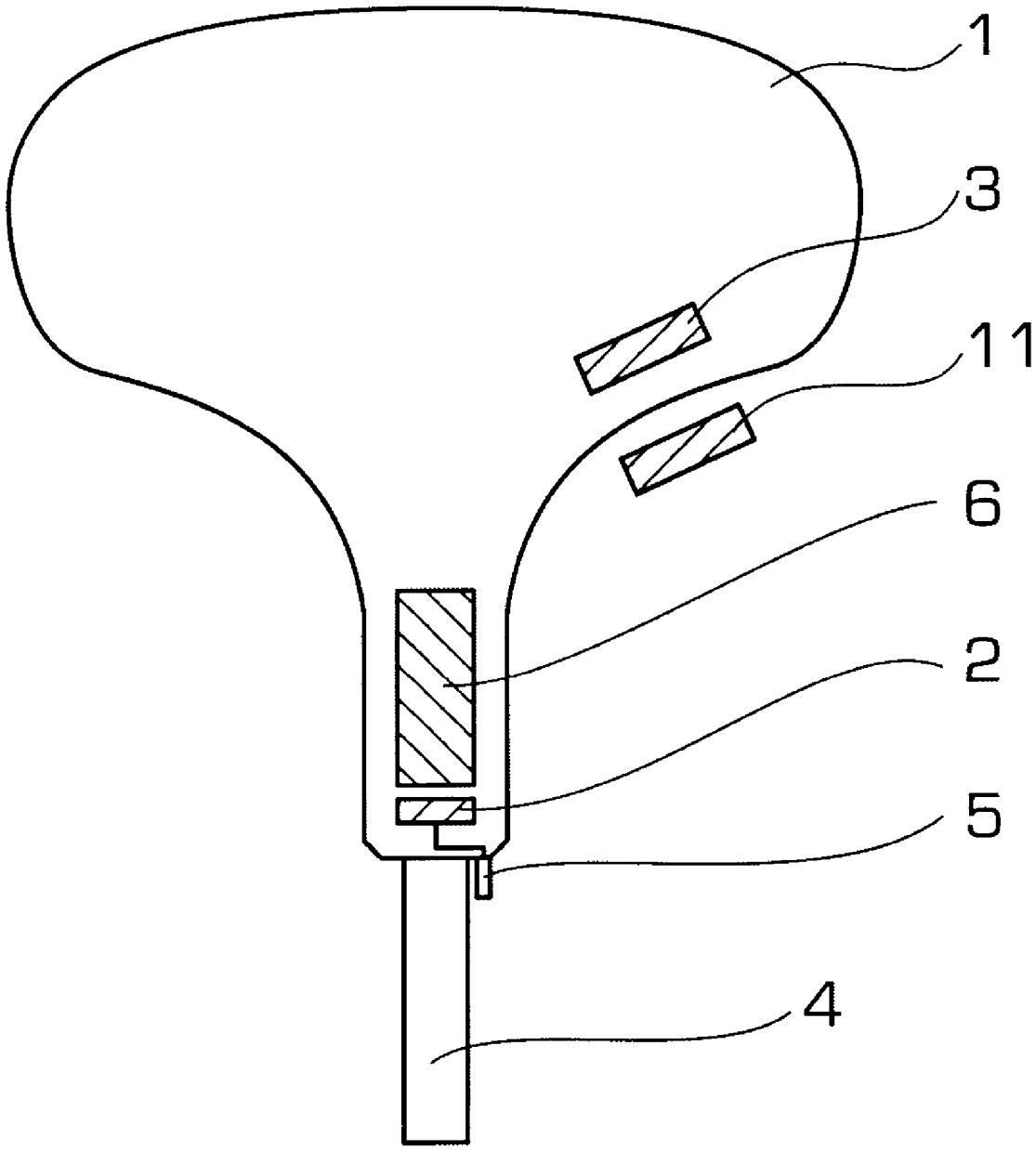
FIG. 1 PRIOR ART
FIG. 1 shows a structural view of a conventional cathode ray tube.
Figure 2:
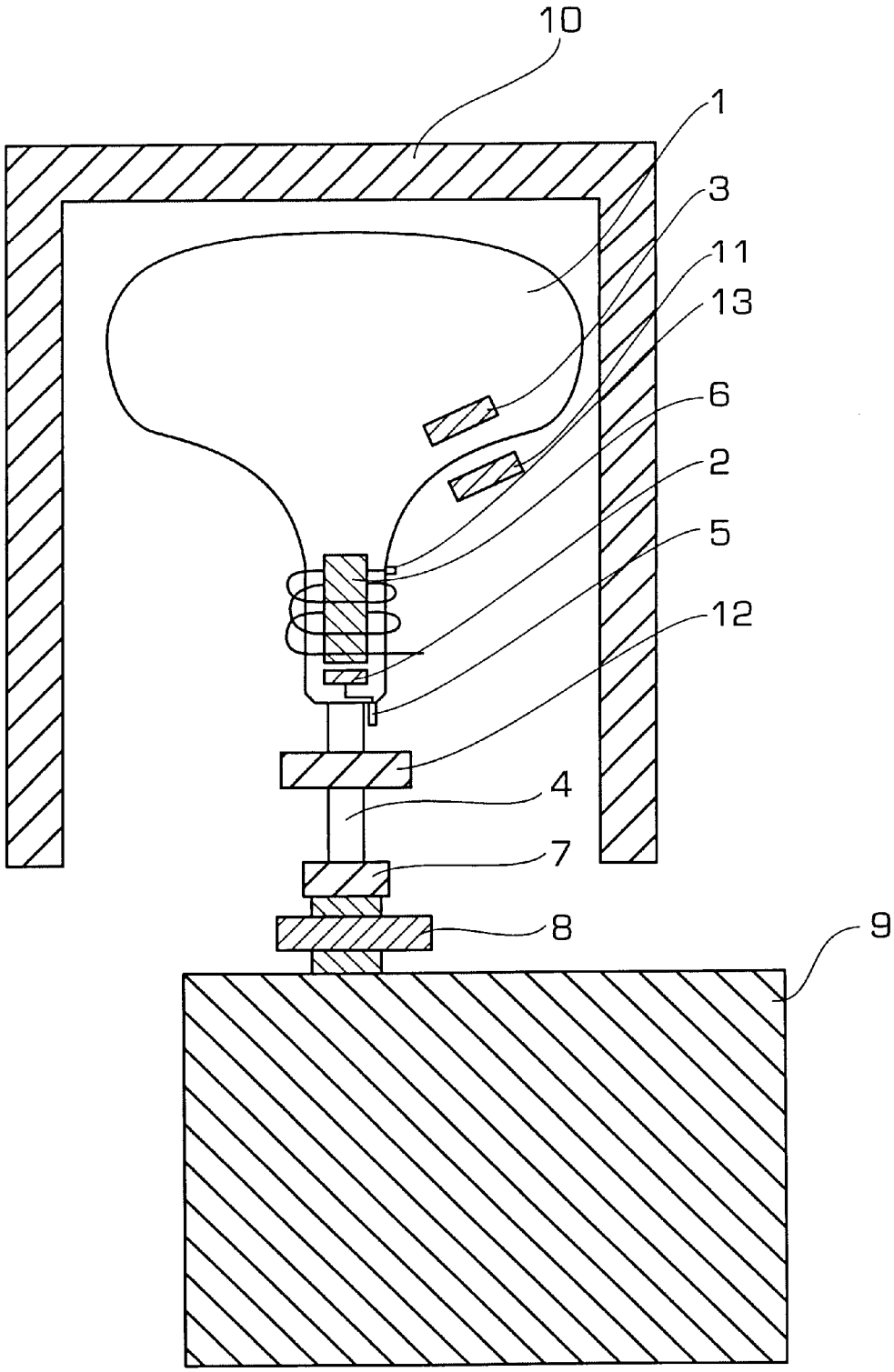
FIG. 2 PRIOR ART
FIG. 2 shows a structural view of an exhaust apparatus for the conventional cathode ray tube.
Figure 8:
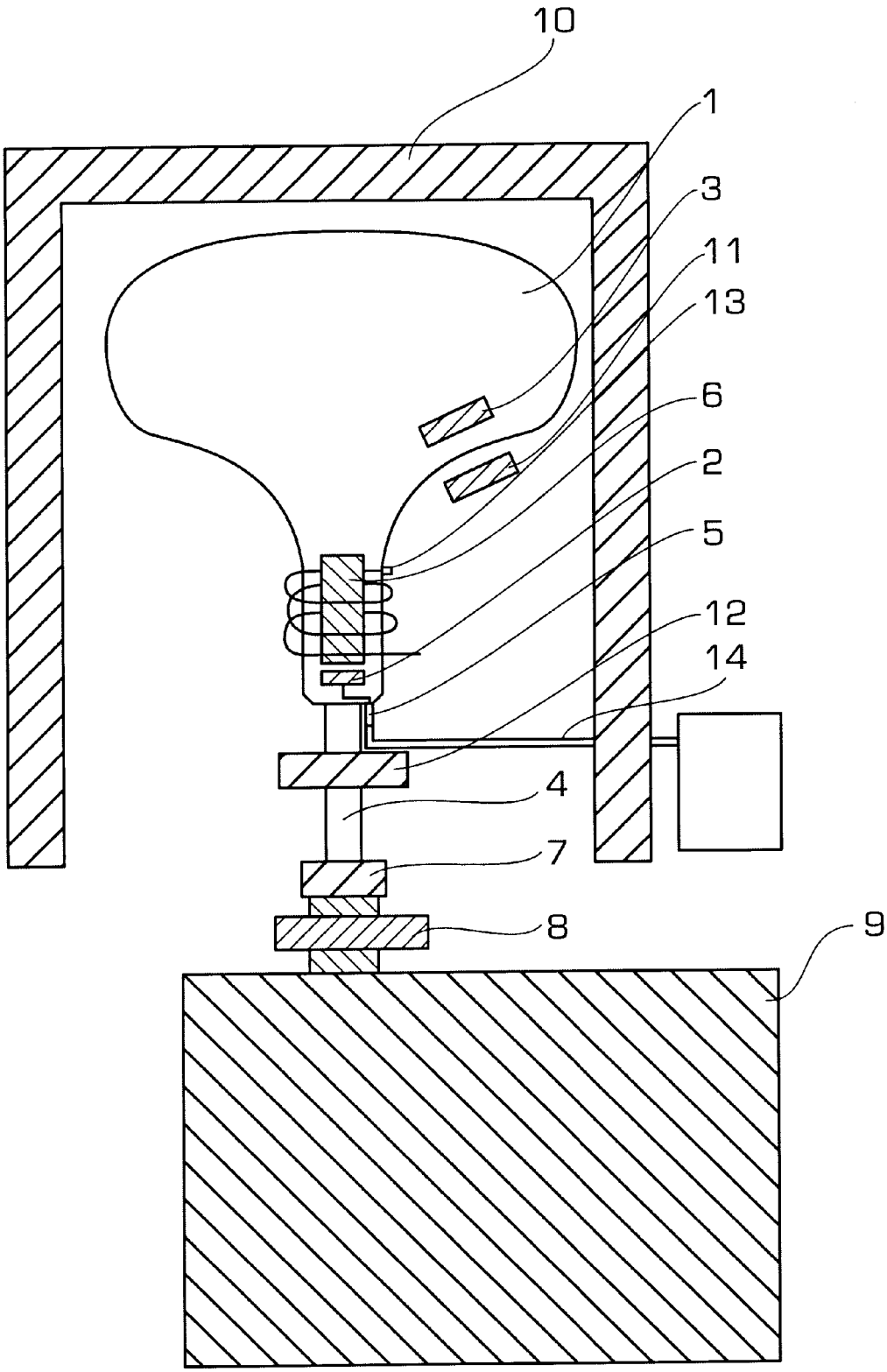
FIG. 8 shows a structural view of an exhaust apparatus adapted to the exhausting process illustrated in FIG. 6.

For executing the above exhaust process, the exhausting apparatus which is substantially similar to the conventional apparatus shown in FIG. 2, is used. However, when it is used in the present invention, as shown in FIG. 8, it is preferable to connect heat-resistant wiring 14 with hermetic pin 5 in advance for impressing the voltage to cathode 2. This is because a first drive of the field emitter, that is, cathode 2 is performed while housing tube body 1 in heating furnace 10. Further, it is preferable that electrode heating induction coil 13 include a current regulating mechanism so that electrode heating induction coil 13 can supply the heating temperature of about 300° C. to electron lens 6 in a stable manner.

Description of the CRT is made above as an example, however, a cathode cleaning method in the exhaust process as in the present invention can also be applied to a flat display panel.

Although description has been made with reference to the cathode using a microfield emitter as an example, a hot cathode can also be employed handling in the same manner. In this case, the hot cathode is heated by a heater to emit electrons.

Next, a cathode cleaning method of a traveling-wave tube (TWT) using a microfield emitter as a cathode will be described with reference to FIG. 9 and FIG. 10.

Figure 9:
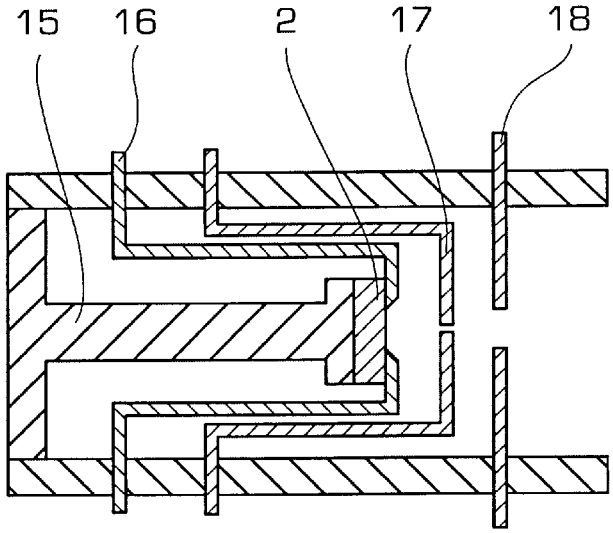
FIG. 9 is a structural view showing an example of an electron gun of a traveling-wave tube which serves as the cathode ray tube according to the present invention.

For example, an electron gun part of the traveling-wave tube is structured as shown in FIG. 9. This figure omits a vacuum vessel which constitutes a tube body and a getter to be disposed in the tube body. Cathode 2 which operates as a microfield emitter is fixed on metal base 15. Base 15 also serves as wiring for supplying electric potential to a cathode cone of said emitter. Wiring 16 is also provided for supplying electric potential to a gate electrode of said emitter. When the traveling-wave tube is practically used, the voltage of 1 KV or more is applied to each electrode of a first anode 17 and a second anode 18, and the voltage of 0 V and 120 V are impressed on the cathode cone of the microfield emitter and on the gate, respectively.

A cathode cleaning method of the traveling-wave tube of this type will be described with reference to FIG. 10.

Figure 10:
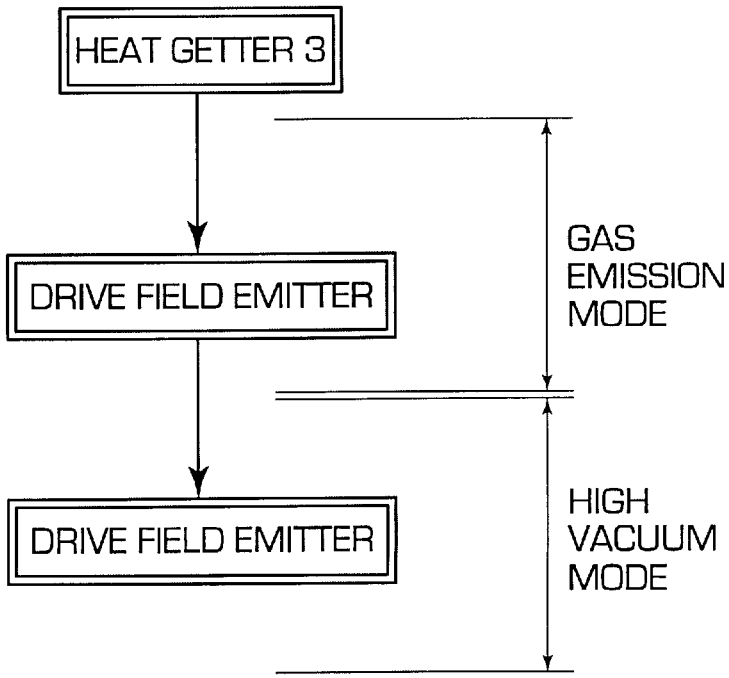
FIG. 10 is a flow chart showing the exhausting method of the cathode ray tube illustrated in FIG. 9.

As shown in FIG. 10, the field emitter is driven after the getter is heated. Although it is not shown in FIG. 10, the exhausting operation of the tube body is continuously conducted from before the getter heating to the completion of the tube sealing. Now, the getter of a non-evaporative type is used. The non-evaporative getter absorbs the residual gas in the tube body utilizing the absorbing function of the getter surface to increase the vacuum level in the tube body. Since the getter surface which has absorbed the residual gas becomes inert, molecular transfer must be made by heating the getter to expose the active surface of the getter. Accompanying the getter heating, gas emission takes place from the getter and things related therewith. Particularly, when the getter is first heated in the vacuum, a large amount of gas included in the getter is emitted. The getter heating process shown in FIG. 10 is a first heating in the vacuum. Since the gas emitted by this heating is ionized by the emitted electrons from the cathode cone and collides with the cathode cone, the surface of the cathode cone is cleaned.

Further, the emitter is driven at the time when the gas is emitted from the getter and the sum of the partial pressure of helium and hydrogen existing in the tube body is 50% or more of the full pressure in the tube body. At the time of this first emitter drive, all the electrode potential is set to 100 V or less for the electric potential of the cathode cone. For example, in case of the traveling-wave tube shown in FIG. 9, the initial voltage of wiring 16, the first anode 17 and the second anode 18 are all set to 100 V, and the initial voltage of base 15 as well as the vessel are set to 0 V. The gate voltage is lowered corresponding to the cathode current. In other words, while the cathode current is monitored for every 1 second, the electric potential of the gate is decreased so that the cathode current may not exceed 100 microampere. Therefore, since the voltage difference in the first emitter drive between the cathode cone and other electrodes is maximum 100 V, the ion collision speed to the cathode cone is reduced. Further, since 50% or more of the residual gas existing in the tube body in the first emitter drive are helium and hydrogen of low mass, the collision force to the cathode cone is mild and can perform the surface cleaning without damaging the cathode cone.

After driving the emitter in this way, tube sealing is performed when it is recognized that the desired vacuum level is achieved according to two effects produced by the exhaust and the absorbing function of the getter. In other words, tube sealing is performed at the time when the inverse pressure phenomenon, in which the full pressure of the tube body becomes lower than the vacuum level of the exhaust pump, does not occur. However, in this example, as shown in FIG. 10, the field emitter driving condition is confirmed before sealing is performed.

While preferred embodiments of the present invention have been described using specific terms, such description is for illustrative purposes only, and it is to be understood that changes and variations may be made without departing from the spirit or scope of the following claims.

What is claimed is:

1. A method of cleaning a cathode of a cathode ray tube having a getter, comprising the steps of:

heating said getter;

operating said cathode while applying a reduced electrical potential having an absolute value less than a normal operating electrical potential of said cathode, and emitting electrons from said cathode after heating said getter;

ionizing gasses within said cathode ray tube using electrons emitted from the cathode while applying said reduced electrical potential to produce ions which collide with the cathode, cleaning the cathode through a sputtering process.

2. A method of cleaning a cathode of a cathode ray tube according to claim 1, wherein the step of emitting electrons from said cathode is performed when the sum of the partial pressure of the gas of the mass number 4 or less included in the residual gas of said cathode ray tube is 50% or more of the full pressure of said residual gas.

3. A method of cleaning a cathode of a cathode ray tube according to claim 2, wherein the step of emitting electrons from said cathode is performed by setting an electric potential difference between said cathode and all parts in said cathode ray tube other than said cathode, within 100 V.

4. A method of cleaning a cathode of a cathode ray tube according to claim 1, wherein said cathode is a microfield emitter.

5. A method of producing a vacuum in a cathode ray tube having a getter, comprising the steps of:

exhausting said cathode ray tube;

heating said getter while said exhaust step is in progress;

emitting electrons from the cathode while continuing said exhaust step, after said getter is heated;

sealing said cathode ray tube, after said electron emission step is performed.

6. A method of producing a vacuum in a cathode ray tube according to claim 5, wherein said sealing step is performed at the time when the full pressure of said cathode ray tube does not become lower than the vacuum level of the exhaust type pump.

7. A method of producing a vacuum in a cathode ray tube according to claim 5, wherein the step of emitting electrons from said cathode is performed when the sum of the partial pressure of the gas of the mass number 4 or less included in the residual gas of said cathode ray tube is 50% or more of the full pressure of said residual gas.

8. A method of producing a vacuum in a cathode ray tube according to claim 7, wherein the step of emitting electrons from said cathode is performed by setting the electric potential difference between said cathode and all parts in said cathode ray tube other than said cathode, within 100 V.

9. A method of producing a vacuum in a cathode ray tube according to claim 8, wherein said cathode is a microfield emitter.

* * * * *